US006470975B1

(12) United States Patent
Bourgoyne et al.

(10) Patent No.: US 6,470,975 B1
(45) Date of Patent: Oct. 29, 2002

(54) INTERNAL RISER ROTATING CONTROL HEAD

(75) Inventors: Darryl A. Bourgoyne, Baton Rouge, LA (US); Don M. Hannegan, Fort Smith, AR (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/516,368

(22) Filed: Mar. 1, 2000

Related U.S. Application Data

(60) Provisional application No. 60/122,530, filed on Mar. 2, 1999.

(51) Int. Cl.[7] ..... E21B 7/00; E21B 17/01; E21B 19/00

(52) U.S. Cl. ..... 175/57; 166/84.3; 166/367

(58) Field of Search ..... 166/80.1, 84.1, 166/84.3, 335, 367; 175/5, 214, 57

(56) References Cited

U.S. PATENT DOCUMENTS

| | | | |
|---|---|---|---|
| 517,509 | A | 4/1894 | Williams |
| 1,157,644 | A | 10/1915 | London |
| 1,472,952 | A | 11/1923 | Anderson |
| 1,503,476 | A | 8/1924 | Childs et al. |
| 1,528,560 | A | 3/1925 | Myers et al. |
| 1,546,467 | A | 7/1925 | Bennett |
| 1,560,763 | A | 11/1925 | Collins |
| 1,700,894 | A | 2/1929 | Joyce et al. |
| 1,708,316 | A | 4/1929 | MacClatchie |
| 1,769,921 | A | 7/1930 | Hansen |

(List continued on next page.)

FOREIGN PATENT DOCUMENTS

WO WO 99/50524 A2 10/1999

OTHER PUBLICATIONS

The Modular T BOP Stack System, Cameron Iron Works ©1985 (5 pages).

Cameron HC Collet Connector, ©1996 Cooper Cameron Corporation, Cameron Division (12 pages).

Riserless drilling: circumventing the size/cost cycle in deepwater—Conoco, Hydril project seek enabling technologies to drill in deepest depths economically, May 1996 Offshore Drilling Technology (pp. 49, 50, 52, 53, 54 and 55).

Williams Tool Company—Home Page—Under Construction Williams Rotating Control Heads (2 pages); Seal–Ability for the pressures of drilling (2 pages); Williams Model 7000 Series Rotating Control Heads (1 page); Williams Model 7000 & 7100 Series Rotating Control Heads (2 pages); Williams Model IP1000 Rotating Control Head (2 pages); Williams Conventional Models 8000 & 9000 (2 pages); Applications Where using a Williams rotating control head while drilling is a plus (1 page); Williams higher pressure rotating control head systems are Ideally Suited for New Technology Flow Drilling and Closed Loop Underbalanced Drilling (UBD) Vertical and Horizontal (2 pages); and How to Contact Us (2 pages).

(List continued on next page.)

*Primary Examiner*—David Bagnell
*Assistant Examiner*—Jennifer H. Gay
(74) *Attorney, Agent, or Firm*—Akin, Gump, Strauss, Hauer & Feld, L.L.P.

(57) ABSTRACT

A system and method provides a barrier between two different fluid densities in a riser while drilling in deepwater. An internal housing and a rotating control head are positioned in a first housing when a blowout preventer is in the sealed position. When the blowout preventer is in the sealed position about the internal housing, a pipe can be rotated for drilling with the pressure of the fluid in the open borehole at one density and the fluid above the seal at another density. When the blowout preventer seal is in the open position, the threadedly connected bearing assembly and internal housing can be removed relatively quickly from the riser.

36 Claims, 7 Drawing Sheets

U.S. PATENT DOCUMENTS

| | | | | |
|---|---|---|---|---|
| 1,776,797 | A | 9/1930 | Sheldon | |
| 1,813,402 | A | 7/1931 | Hewitt | |
| 1,831,956 | A | 11/1931 | Harrington | |
| 1,836,470 | A | 12/1931 | Humason et al. | |
| 1,902,906 | A | 3/1933 | Seamark | |
| 1,942,366 | A | 1/1934 | Seamark | 166/14 |
| 2,036,537 | A | 4/1936 | Otis | 255/1 |
| 2,071,197 | A | 2/1937 | Burns et al. | 286/26 |
| 2,124,015 | A | 7/1938 | Stone et al. | 166/15 |
| 2,126,007 | A | 8/1938 | Guiberson et al. | 255/1 |
| 2,144,682 | A | 1/1939 | MacClatchie | 255/1 |
| 2,163,813 | A | 6/1939 | Stone et al. | 166/14 |
| 2,165,410 | A | 7/1939 | Penick et al. | 255/1 |
| 2,170,915 | A | 8/1939 | Schweitzer | 286/16 |
| 2,170,916 | A | 8/1939 | Schweitzer et al. | 255/1 |
| 2,175,648 | A | 10/1939 | Roach | 166/14 |
| 2,176,355 | A | 10/1939 | Otis | 255/1 |
| 2,185,822 | A | 1/1940 | Young | 285/97.9 |
| 2,199,735 | A | 5/1940 | Beckman | 255/1 |
| 2,222,082 | A | 11/1940 | Leman et al. | 255/1 |
| 2,233,041 | A | 2/1941 | Alley | 166/14 |
| 2,243,340 | A | 5/1941 | Hild | 255/1 |
| 2,243,439 | A | 5/1941 | Pranger et al. | 255/1 |
| 2,287,205 | A | 6/1942 | Stone | 286/16 |
| 2,303,090 | A | 11/1942 | Pranger et al. | 255/19 |
| 2,313,169 | A | 3/1943 | Penick et al. | 166/14 |
| 2,325,556 | A | 7/1943 | Taylor, Jr. et al. | 309/4 |
| 2,338,093 | A | 1/1944 | Caldwell | 255/23 |
| 2,480,955 | A | 9/1949 | Penick | 235/22 |
| 2,506,538 | A | 5/1950 | Bennett | 255/23 |
| 2,529,744 | A | 11/1950 | Schweitzer | 286/16 |
| 2,609,836 | A | 9/1952 | Knox | 137/618 |
| 2,628,852 | A | 2/1953 | Voytech | 286/11.14 |
| 2,646,999 | A | 7/1953 | Barske | 286/9 |
| 2,649,318 | A | 8/1953 | Skillman | 286/19 |
| 2,731,281 | A | 1/1956 | Knox | 286/16.1 |
| 2,746,781 | A | 5/1956 | Jones | 288/2 |
| 2,760,750 | A | 8/1956 | Schweitzer, Jr. et al. | 251/2 |
| 2,760,795 | A | 8/1956 | Vertson | 286/11.15 |
| 2,764,999 | A | 10/1956 | Stanbury | 138/31 |
| 2,808,229 | A | 10/1957 | Bauer et al. | 255/2.5 |
| 2,808,230 | A | 10/1957 | McNeill et al. | 255/2.5 |
| 2,846,178 | A | 8/1958 | Minor | 251/2 |
| 2,846,247 | A | 8/1958 | Davis | 286/16.1 |
| 2,853,274 | A | 9/1958 | Collins | 255/23 |
| 2,862,735 | A | 12/1958 | Knox | 286/16.2 |
| 2,886,350 | A | 5/1959 | Horne | 286/9 |
| 2,904,357 | A | 9/1959 | Knox | 286/16.1 |
| 2,927,774 | A | 3/1960 | Ormsby | 255/23 |
| 2,929,610 | A | 3/1960 | Stratton | 255/1.8 |
| 2,995,196 | A | 8/1961 | Gibson et al. | 175/7 |
| 3,023,012 | A | 2/1962 | Wilde | 277/31 |
| 3,029,083 | A | 4/1962 | Wilde | 277/164 |
| 3,032,125 | A | 5/1962 | Hiser et al. | 175/7 |
| 3,033,011 | A | 5/1962 | Garrett | 64/11 |
| 3,052,300 | A | 9/1962 | Hampton | 166/84 |
| 3,100,015 | A | 8/1963 | Regan | 166/46 |
| 3,128,614 | A | 4/1964 | Auer | 64/23.5 |
| 3,134,613 | A | 5/1964 | Regan | 285/142 |
| 3,176,996 | A | 4/1965 | Barnett | 277/2 |
| 3,203,358 | A | 8/1965 | Regan et al. | 103/203 |
| 3,209,829 | A | 10/1965 | Haeber | |
| 3,216,731 | A | 11/1965 | Dollison | 277/1 |
| 3,225,831 | A | 12/1965 | Knox | 166/75 |
| 3,259,198 | A | 7/1966 | Montgomery et al. | |
| 3,268,233 | A | 8/1966 | Brown | 277/31 |
| 3,285,352 | A | 11/1966 | Hunter | 175/214 |
| 3,288,472 | A | 11/1966 | Watkins | 277/11 |
| 3,289,761 | A | 12/1966 | Smith et al. | 166/27 |
| 3,294,112 | A | 12/1966 | Watkins | 137/494 |
| 3,313,345 | A | 4/1967 | Fischer | 166/0.5 |
| 3,313,358 | A | 4/1967 | Postlewaite et al. | 175/7 |
| 3,323,773 | A | 6/1967 | Walker | 251/1 |
| 3,333,870 | A | 8/1967 | Watkins | 285/18 |
| 3,347,567 | A | 10/1967 | Watkins | 285/24 |
| 3,360,048 | A | 12/1967 | Watkins | 166/87 |
| 3,372,761 | A | 3/1968 | van Gils | |
| 3,387,851 | A | 6/1968 | Cugini | 277/2 |
| 3,400,938 | A | 9/1968 | Williams | 277/31 |
| 3,445,126 | A | 5/1969 | Watkins | 285/85 |
| 3,452,815 | A | 7/1969 | Watkins | 166/0.5 |
| 3,472,518 | A | 10/1969 | Harlan | 277/31 |
| 3,485,051 | A | 12/1969 | Watkins | 61/46.5 |
| 3,492,007 | A | 1/1970 | Jones | 277/31 |
| 3,493,043 | A | 2/1970 | Watkins | 166/0.5 |
| 3,529,835 | A | 9/1970 | Lewis | 277/2 |
| 3,587,734 | A | 6/1971 | Shaffer | |
| 3,603,409 | A | 9/1971 | Watkins | 175/7 |
| 3,621,912 | A | 11/1971 | Wooddy, Jr. | 166/0.5 |
| 3,631,834 | A | 1/1972 | Gardner et al. | 115/34 |
| 3,638,721 | A | 2/1972 | Harrison | 166/0.5 |
| 3,638,742 | A | 2/1972 | Wallace | 175/325 |
| 3,653,350 | A | 4/1972 | Koons et al. | 114/0.5 |
| 3,661,409 | A | 5/1972 | Brown et al. | 285/82 |
| 3,664,376 | A | 5/1972 | Watkins | 137/625.68 |
| 3,667,721 | A | 6/1972 | Vujasinovic | 251/1 |
| 3,677,353 | A | 7/1972 | Baker | 175/25 |
| 3,724,862 | A | 4/1973 | Biffle | 277/31 |
| 3,779,313 | A | 12/1973 | Regan | 166/0.6 |
| 3,815,673 | A | 6/1974 | Bruce et al. | |
| 3,827,511 | A | 8/1974 | Jones | 175/25 |
| 3,868,832 | A | 3/1975 | Biffle | 64/23.5 |
| 3,934,887 | A | 1/1976 | Biffle | 277/31 |
| 3,952,526 | A | 4/1976 | Watkins et al. | 61/46 |
| 3,955,622 | A | 5/1976 | Jones | 166/0.5 |
| 3,965,987 | A | 6/1976 | Biffle | 166/315 |
| 3,976,148 | A | 8/1976 | Maus et al. | 175/7 |
| 3,984,990 | A | 10/1976 | Jones | 61/99 |
| 3,992,889 | A | 11/1976 | Watkins et al. | 61/86 |
| 3,999,766 | A | 12/1976 | Barton | 277/28 |
| 4,037,890 | A | 7/1977 | Kurita et al. | 308/187 |
| 4,046,191 | A | 9/1977 | Neath | 166/0.5 |
| 4,063,602 | A | 12/1977 | Howell et al. | |
| 4,091,881 | A | 5/1978 | Maus | 175/7 |
| 4,098,341 | A | 7/1978 | Lewis | 166/314 |
| 4,099,583 | A | 7/1978 | Maus | |
| 4,109,712 | A | 8/1978 | Regan | 166/340 |
| 4,143,880 | A | 3/1979 | Bunting et al. | 277/31 |
| 4,143,881 | A | 3/1979 | Bunting | 277/31 |
| 4,149,603 | A | 4/1979 | Arnold | 175/7 |
| 4,154,448 | A | 5/1979 | Biffle | 277/31 |
| 4,157,186 | A | 6/1979 | Murray et al. | 277/31 |
| 4,183,562 | A | 1/1980 | Watkins et al. | 285/405 |
| 4,200,312 | A | 4/1980 | Watkins | 285/18 |
| 4,208,056 | A | 6/1980 | Biffle | 277/31 |
| 4,222,590 | A | 9/1980 | Regan | 285/14 |
| 4,281,724 | A | 8/1981 | Garrett | 175/195 |
| 4,282,939 | A | 8/1981 | Maus et al. | 175/7 |
| 4,285,406 | A | 8/1981 | Garrett et al. | 175/195 |
| 4,291,772 | A | 9/1981 | Beynet | 175/5 |
| 4,293,047 | A | 10/1981 | Young | 175/195 |
| 4,304,310 | A | 12/1981 | Garrett | 175/195 |
| 4,312,404 | A | 1/1982 | Morrow | 166/84 |
| 4,326,584 | A | 4/1982 | Watkins | 166/82 |
| 4,349,204 | A | 9/1982 | Malone | 277/34 |
| 4,355,784 | A | 10/1982 | Cain | 251/63 |
| 4,361,185 | A | 11/1982 | Biffle | 166/84 |
| 4,363,357 | A | 12/1982 | Hunter | 166/84 |
| 4,367,795 | A | 1/1983 | Biffle | 166/84 |
| 4,383,577 | A | 5/1983 | Pruitt | 166/95 |
| 4,398,599 | A | 8/1983 | Murray | 166/95 |

| | | | | | |
|---|---|---|---|---|---|
| 4,406,333 | A | | 9/1983 | Adams | 175/209 |
| 4,413,653 | A | | 11/1983 | Carter, Jr. | 138/89 |
| 4,416,340 | A | | 11/1983 | Bailey | 175/195 |
| 4,423,776 | A | | 1/1984 | Wagoner et al. | 166/84 |
| 4,424,861 | A | | 1/1984 | Carter, Jr. et al. | 166/120 |
| 4,441,551 | A | | 4/1984 | Biffle | 166/84 |
| 4,444,250 | A | | 4/1984 | Keithahn et al. | 166/84 |
| 4,444,401 | A | | 4/1984 | Roche et al. | 277/30 |
| 4,448,255 | A | | 5/1984 | Shaffer et al. | 166/387 |
| 4,456,062 | A | | 6/1984 | Roche et al. | 166/84 |
| 4,456,063 | A | | 6/1984 | Roche | 166/84 |
| 4,480,703 | A | | 11/1984 | Garrett | 175/195 |
| 4,486,025 | A | | 12/1984 | Johnston | 277/31 |
| 4,500,094 | A | | 2/1985 | Biffle | 277/31 |
| 4,502,534 | A | | 3/1985 | Roche et al. | 166/84 |
| 4,524,832 | A | | 6/1985 | Roche et al. | 166/347 |
| 4,526,243 | A | | 7/1985 | Young | 175/195 |
| 4,527,632 | A | | 7/1985 | Chaudot | |
| 4,529,210 | A | | 7/1985 | Biffle | 277/31 |
| 4,531,580 | A | | 7/1985 | Jones | 166/84 |
| 4,531,593 | A | | 7/1985 | Elliott et al. | |
| 4,546,828 | A | | 10/1985 | Roche | 166/84 |
| 4,553,591 | A | | 11/1985 | Mitchell | 166/76 |
| D282,073 | S | | 1/1986 | Bearden et al. | D15/21 |
| 4,566,494 | A | | 1/1986 | Roche | 137/872 |
| 4,595,343 | A | | 6/1986 | Thompson et al. | |
| 4,597,447 | A | | 7/1986 | Roche et al. | 166/347 |
| 4,611,661 | A | | 9/1986 | Hed et al. | |
| 4,618,314 | A | | 10/1986 | Hailey | 417/53 |
| 4,621,655 | A | | 11/1986 | Roche | 137/81.2 |
| 4,626,135 | A | | 12/1986 | Roche | 405/195 |
| 4,646,844 | A | | 3/1987 | Roche et al. | 166/379 |
| 4,697,484 | A | | 10/1987 | Klee et al. | 82/1.5 |
| 4,719,937 | A | | 1/1988 | Roche et al. | 137/114 |
| 4,745,970 | A | | 5/1988 | Bearden et al. | 165/84 |
| 4,754,820 | A | | 7/1988 | Watts et al. | 175/195 |
| 4,783,084 | A | | 11/1988 | Biffle | 277/9 |
| 4,813,495 | A | | 3/1989 | Leach | 175/6 |
| 4,825,938 | A | | 5/1989 | Davis | 166/84 |
| 4,828,024 | A | | 5/1989 | Roche | 166/84 |
| 4,832,126 | A | | 5/1989 | Roche | 166/358 |
| 4,836,289 | A | | 6/1989 | Young | 166/379 |
| 4,909,327 | A | | 3/1990 | Roche | 166/359 |
| 4,949,796 | A | | 8/1990 | Williams | 175/209 |
| 4,971,148 | A | | 11/1990 | Roche et al. | 166/88 |
| 5,022,472 | A | | 6/1991 | Bailey et al. | 175/195 |
| 5,028,056 | A | | 7/1991 | Bemis et al. | 277/227 |
| 5,137,084 | A | | 8/1992 | Gonzales et al. | 166/84 |
| 5,163,514 | A | * | 11/1992 | Jennings | 166/368 |
| 5,178,215 | A | | 1/1993 | Yenulis et al. | 166/80 |
| 5,184,686 | A | | 2/1993 | Gonzalez | |
| 5,213,158 | A | | 5/1993 | Bailey et al. | 166/82 |
| 5,215,151 | A | | 6/1993 | Smith et al. | 175/45 |
| 5,224,557 | A | | 7/1993 | Yenulis et al. | 175/195 |
| 5,277,249 | A | | 1/1994 | Yenulis et al. | |
| 5,279,365 | A | * | 1/1994 | Yenulis et al. | 166/84.3 |
| 5,320,325 | A | | 6/1994 | Young et al. | |
| 5,322,137 | A | | 6/1994 | Gonzales | |
| 5,647,444 | A | | 7/1997 | Williams | 175/209 |
| 5,662,171 | A | * | 9/1997 | Brugman et al. | 166/383 |
| 5,662,181 | A | | 9/1997 | Williams et al. | 175/195 |
| 5,848,643 | A | | 12/1998 | Carbaugh et al. | |
| 6,102,673 | A | | 8/2000 | Mott et al. | |
| 6,129,152 | A | * | 10/2000 | Hosie et al. | 166/384 |
| 6,138,774 | A | * | 10/2000 | Bourgoyne, Jr. et al. | 175/7 |
| 6,230,824 | B1 | | 5/2001 | Peterman et al. | |

OTHER PUBLICATIONS

Offshore—World Trends and Technology for Offshore Oil and Gas Operations, Mar. 1998, Seismic: Article entitled, "Shallow Flow Diverter JIP Spurred by Deepwater Washouts" (3 pages including cover page, table of contents and p. 90).

Williams Tool Co., Inc. Rotating Control Heads and Strippers for Air, Gas, Mud, and Geothermal Drilling Worldwide—Sales Rental Service, ©1988 (19 pages).

Williams Tool Co., Inc. 19 page brochure ©1991 Williams Tool Co., Inc. (19 pages).

Fig. 14, Floating Piston Drilling Choke Design; May of 1997.

Blowout Preventer Testing for Underbalanced Drilling by Charles R. "Rick" Stone and Larry A Cress, Signa Engineering Corp., Houston, Texas (24 pages) Sep. 1997.

Williams Tool Co., Inc. Instructions, Assemble & Disassemble Model 9000 Bearing Assembly (cover page and 27 numbered pages).

Williams Tool Co., Inc. Rotating Control Heads Making Drilling Safer While Reducing Costs Since 1968, ©1989 (4 pages).

Williams Tool Company, Inc. International Model 7000 Rotating Control Head, ©1991 (4 pages).

Williams Rotating Control Heads, Reduce Costs Increase Safety Reduce Environmental Impact (4 pages).

Williams Tool Co., Inc., Sales—Rental—Service, Williams Rotating Control Heads and Strippers for Air, Gas, Mud, and Geothermal Drilling, ©1982 (7 pages).

Williams Tool Co., Inc., Rotating Control Heads and Strippers for Air, Gas, Mud, Geothermal and Pressure Drilling, ©1991 (19 pages).

An article—The Brief January '96, The Brief's Guest Columnists, Williams Tool Co., Inc., Communicating Dec. 13, 1995 (Fort Smith, Arkansas) The When? and Why? of Rotating Control Head Usage, Copyright ©Murphy Publishing, Inc. 1996 (2 pages).

A reprint from the Oct. 9, 1995 edition of Oil & Gas Journal, "Rotating control head applications increasing", by Adam T. Bourgoyne, Jr., Copyright 1995 by PennWell Publishing Company (6 pages).

1966–1967 Composite Catalog—Grant Rotating Drilling Head for Air, Gas, or Mud Drilling, (1 page).

1976–1977 Composite Catalog Grant Oil Tool Company Rotating Drilling Head Models 7068, 7368, 8068 (Patented), Equally Effective with Air, Gas, or Mud Circulation Media (3 pages).

A Subsea Rotating Control Head for Riserless Drilling Applications, Darryl A. Bourgoyne, BEI; Adam T. Bourgoyne, Jr., Louisiana State University; and Don Hannegan, Williams Tool Company, Inc. Copyright 1998 (pp. 1–14).

Williams Tool Co., Inc., "Rotating Control Heads and Strippers for Air, Gas, Mud, and Geothermal Drilling," cover and pp. 1–16, Fort Smith, Arkansas 1988.

Williams Tool Co., Inc., "Rotating Control Heads and Strippers for Air, Gas, Mud, Geothermal cover and Drilling," pp. 1–16, Fort Smith, Arkansas 1991.

Hannegan, "Applications Widening for Rotating Control Heads," Drilling Contractor, cover page, table of contents and pp. 17–19, Drilling Contractor Publications, Inc., Houston, Texas Jul., 1996.

Composite Catalog, Hughes Offshore 1986–1987 Subsea Systems and Equipment, Hughes Drilling Equipment Composite Catalog (pp. 2986–3004).

Williams Tool Co., Inc., Technical Specifications Model for The Model 7100, (3 pages).
Williams Tool Co., Inc., Website, Underbalanced Drilling (UBD), The Attraction of UBD (2 pages).
Williams Tool Co., Inc. Website, "Applications, Where Using a Williams Rotating Control Head While Drilling is a Plus" (2 pages).
Williams Tool Co., Inc. Website, "Model 7100," (3 pages).
Composite Catalog, Hughes Offshore 1982/1983, Regan Products, ©1982, (Two cover sheets and 4308–27 thru 4308–43, and end sheet) See p. 4308–36 Type KFD Diverter.
Coflexip Brochure; 1—Coflexip Sales Offices, 2—The Flexible Steel Pipe for Drilling and Service Applications, 3—New 5" I.D. General Drilling Flexible, 4–Applications, and 5–Illustration (5 unnumbered pages).
Baker, Ron, "A Primer of Oilwell Drilling", Fourth Edition, Published by Petroleum Extension Service, The University of Texas at Austin, Austin, Texas, in cooperation with International Association of Drilling Contractors Houston Texas ©1979, (3 cover pages and pp. 42–49 re Circulation System).
Brochure, Lock Down Lubricator System, Dutch Enterprises Inc., "Safety with Savings," (cover sheet and 16 unnumbered pages) See above U.S. application No. 4,836,289 referred to therein on pp. D–6 and D–7.
Hydril GL series Annular Blowout Preventers (Patented—see Roche patents above), (cover sheet and 2 pages).
Other Hydril Product Information (The GH Gas Handler Series Product is Listed), ©1996, Hydril Company (Cover sheet and 19 pages).
Brochure, Shaffer Type 79 Rotating Blowout Preventer, NL Rig Equipment/NL Industries, Inc., (6 unnumbered pages).
Shaffer, A Varco Company, (Cover page and pp. 1562–1568).
Avoiding Explosive Unloading of Gas in a Deep Water Riser When SOBM is in Use; Colin P. Leach & Joseph R. Roche—1998 (The Paper Describes an Application for the Hydril Gas Handler, The Hydril GH 211–2000 Gas Handler is Depicted in Figure 1 of the Paper), (9 unnumbered pages).
Feasibility Study of Dual Density Mud System for Deepwater Drilling Operations; Clovis A. Lopes & A.T. Bourgoyne Jr.—1997 (Offshore Technology Conference Paper No. 8465); (pp. 257–266).
A Subsea Rotating Control Head for Riserless Drilling Applications; Darryl A. Bourgoyne, Adam T. Bourgoyne, and Don Hannegan—1998 (International Association of Drilling Contractors International Deep Water Well Control Conference held in Houston, Texas, Aug. 26–27, 1998), (14 pages).
April 1998 Offshore Drilling with Light Weight Fluids Joint Industry Project Presentation, (9 unnumbered pages).

Nakagawa, Edson Y., Santos, Helio and Cunha, J.C., "Application of Aerated–Fluid Drilling in Deepwater", SPE/IADC 52787 Presented by Don Hannegan, P.E., SPE ©1999 SPE/IADC Drilling Conference, Amsterdam, Holland, Mar. 9–11, 1999 (5 unnumbered pages).

Brochure: "Inter–Tech Drilling Solutions Ltd.'s RBOP™ Means Safety and Experience for Underbalanced Drilling", Inter–Tech Drilling Solutions Ltd./Big D Rentals & Sales (1981) Ltd. and Color Copy of "Rotating BOP" (2 unnumbered pages).

"Pressure Control While Drilling", Shaffer® A Varco Company, Rev. A (2 unnumbered pages).

Field Exposure (As of Aug. 1998), Shaffer® A Varco Company (1 unnumbered page).

Graphic: "Rotating Spherical BOP" (1 unnumbered page).

"JIP's Work Brightens Outlook for UBD in Deep Waters" by Edson Yoshihito Nakagawa, Helio Santos and Jose Carlos Cunha, American Oil & Gas Reporter, Apr. 1999, pp. 53, 56, 58–60 and 63.

D. O. Nessa, M. J. Tangedahl, J. Saponja, "Offshore underbalanced drilling system could revive field developments", World Oil Exploration Drilling Production, vol. 218 No. 7, Color copies of Cover Page and pp. 3, 61–64, and 66, Jul. 1997.

D.O. Nessa, M. J. Tangedahl, J. Saponja, "Offshore underbalanced drilling system could revive field developments", World Oil Exploration Drilling Production, vol. 218 No. 10, Cover Page and pp. 3, 83–84, 86, and 88, Oct. 1997.

PCT Search Report, International Application No. PCT/US99/06695, 4 pages (Date of Completion May 27, 1999).

PCT Search Report, International Application No. PCT/GB00/00731, 3 pages (Date of Completion, Jun. 16, 2000).

National Academy of Sciences—National Research Council, "Design of a Deep Ocean Drilling Ship", Cover Page and pp. 114–121, Undated but cited in above U.S. application No. 6,230,824B1.

* cited by examiner

FIG. 8
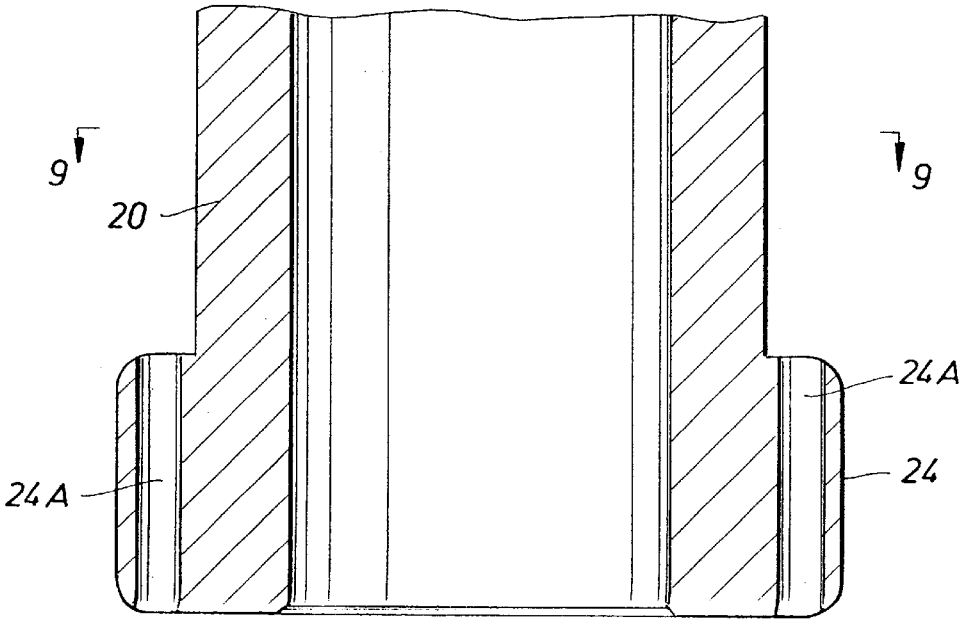
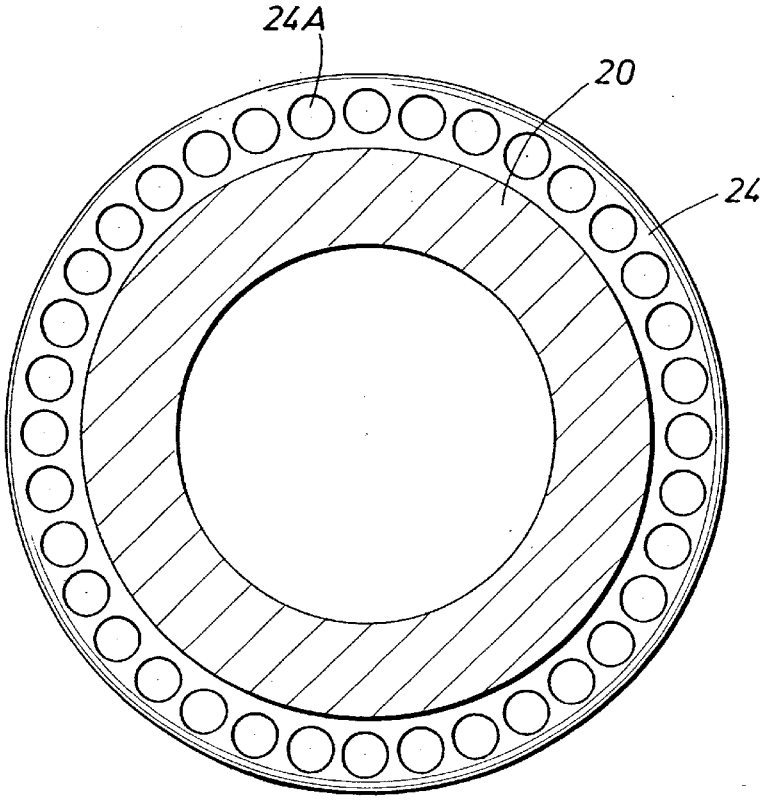
FIG. 9

INTERNAL RISER ROTATING CONTROL HEAD

PRIORITY CLAIMED

This application claims the benefit of and priority to U.S. Provisional Application Serial No. 60/122,530, filed Mar. 2, 1999, entitled "Concepts for the Application of Rotating Control Head Technology to Deepwater Drilling Operations," which is hereby incorporated by reference in its entirety for all purposes.

SPECIFICATION

BACKGROUND OF THE INVENTION

1. Field of the Invention

The present invention relates to a method and system for drilling in deepwater. In particular, the present invention relates to a system for a quick release seal for sealing while drilling in deepwater using a rotatable pipe and a method for use of the system.

2. Description of the Related Art

Marine risers extending from a wellhead fixed on the floor of an ocean have been used to circulate drilling fluid back to a structure or rig. The riser must be large enough in internal diameter to accommodate the largest bit and pipe that will be used in drilling a borehole into the floor of the ocean. Conventional risers now have internal diameters of 19½ inches, though other diameters can be used.

An example of a marine riser and some of the associated drilling components, such as shown in FIG. 1, is proposed in U.S. Pat. No. 4,626,135, assigned on its face to the Hydril Company, which is incorporated herein by reference for all purposes. Since the riser R is fixedly connected between a floating structure or rig S and the wellhead W, as proposed in the '135 Hydril patent, a conventional slip or telescopic joint SJ, comprising an outer barrel OB and an inner barrel IB with a pressure seal therebetween, is used to compensate for the relative vertical movement or heave between the floating rig and the fixed riser. A Diverter has been connected between the top inner barrel IB of the slip joint SJ and the floating structure or rig S to control gas accumulations in the subsea riser R or low pressure formation gas from venting to the rig floor F. A ball joint BJ between the diverter D and the riser R compensates for other relative movement (horizontal and rotational) or pitch and roll of the floating structure S and the fixed riser R.

The diverter D can use a rigid diverter line DL extending radially outwardly from the side of the diverter housing to communicate drilling fluid or mud from the riser R to a choke manifold CM, shale shaker SS or other drilling fluid receiving device. Above the diverter D is the rigid flowline RF, shown in FIG. 1, configured to communicate with the mud pit MP. If the drilling fluid is open to atmospheric pressure at the bell-nipple in the rig floor F, the desired drilling fluid receiving device must be limited by an equal height or level on the structure S or, if desired, pumped by a pump to a higher level. While the shale shaker SS and mud pits MP are shown schematically in FIG. 1, if a bell-nipple were at the rig floor F level and the mud return system was under minimal operating pressure, these fluid receiving devices may have to be located at a level below the rig floor F for proper operation. Since the choke manifold CM and separator MB are used when the well is circulated under pressure, they do not need to be below the bell nipple.

As also shown in FIG. 1, a conventional flexible choke line CL has been configured to communicate with choke manifold CM. The drilling fluid then can flow from the choke manifold CM to a mud-gas buster or separator MB and a flare line (not shown). The drilling fluid can then be discharged to a shale shaker SS, and mud pits MP. In addition to a choke line CL and kill line KL, a booster line BL can be used.

In the past, when drilling in deepwater with a marine riser, the riser has not been pressurized by mechanical devices during normal operations. The only pressure induced by the rig operator and contained by the riser is that generated by the density of the drilling mud held in the riser (hydrostatic pressure). During some operations, gas can unintentionally enter the riser from the wellbore. If this happens, the gas will move up the riser and expand. As the gas expands, it will displace mud, and the riser will "unload". This unloading process can be quite violent and can pose a significant fire risk when gas reaches the surface of the floating structure via the bell-nipple at the rig floor F. As discussed above, the riser diverter D, as shown in FIG. 1, is intended to convey this mud and gas away from the rig floor F when activated. However, diverters are not used during normal drilling operations and are generally only activated when indications of gas in the riser are observed. The '135 Hydril patent has proposed a gas handler annular blowout preventer GH, such as shown in FIG. 1, to be installed in the riser R below the riser slip joint SJ. Like the conventional diverter D, the gas handler annular blowout preventer GH is activated only when needed, but instead of simply providing a safe flow path for mud and gas away from the rig floor F, the gas handler annular blowout provider GH can be used to hold limited pressure on the riser R and control the riser unloading process. An auxiliary choke line ACL is used to circulate mud from the riser R via the gas handler annular blowout provider GH to a choke manifold CM on the rig.

Recently, the advantages of using underbalanced drilling, particularly in mature geological deepwater environments, have become known. Deepwater is considered to be between 3,000 to 7,500 feet deep and ultra deepwater is considered to be 7,500 to 10,000 feet deep. Rotating control heads, such as disclosed in U.S. Pat. No. 5,662,181, have provided a dependable seal between a rotating pipe and the riser while drilling operations are being conducted. U.S. Ser. No. 09/033,190, filed Mar. 2, 1998, entitled "Method and Apparatus for Drilling a Borehole Into A Subsea Abnormal Pore Pressure Environment" proposes the use of a rotating control head for overbalanced drilling of a borehole through subsea geological formations. That is, the fluid pressure inside of the borehole is maintained equal to or greater than the pore pressure in the surrounding geological formations using a fluid that is of insufficient density to generate a borehole pressure greater than the surrounding geological formation's pore pressures without pressurization of the borehole fluid. U.S. Ser. No. 09/260,642, filed Mar. 2, 1999, proposes an underbalanced drilling concept of using a rotating control head to seal a marine riser while drilling in the floor of an ocean using a rotatable pipe from a floating structure. U.S. Pat. No. 5,662,181 and Ser. Nos. 09/033,190 and 09/260,642 are incorporated herein by reference for all purposes. Additionally, provisional application Serial No. 60/122,350, filed Mar. 2, 1999, entitled "Concepts for the Application of Rotating Control Head Technology to Deepwater Drilling Operations" is incorporated herein by reference for all purposes.

It has also been known in the past to use a dual density mud system to control formations exposed in the open borehole. See *Feasibility Study of a Dual Density Mud System For Deepwater Drilling Operations* by Clovis A.

Lopes and Adam T. Bourgoyne, Jr., © 1997 Offshore Technology Conference. As a high density mud is circulated from the ocean floor back to the rig, gas is proposed in this May of 1997 paper to be injected into the mud column at or near the ocean floor to lower the mud density. However, hydrostatic control of abnormal formation pressure is proposed to be maintained by a weighted mud system that is not gas-cut below the seafloor. Such a dual density mud system is proposed to reduce drilling costs by reducing the number of casing strings required to drill the well and by reducing the diameter requirements of the marine riser and subsea blowout preventers. This dual density mud system is similar to a mud nitrification system, where nitrogen is used to lower mud density, in that formation fluid is not necessarily produced during the drilling process.

U.S. Pat. No. 4,813,495 proposes an alternative to the conventional drilling method and apparatus of FIG. 1 by using a subsea rotating control head in conjunction with a subsea pump that returns the drilling fluid to a drilling vessel. Since the drilling fluid is returned to the drilling vessel, a fluid with additives may economically be used for continuous drilling operations. ('495 patent, col. 6, In. 15 to col. 7, In. 24) Therefore, the '495 patent moves the base line for measuring pressure gradient from the sea surface to the mudline of the sea floor ('495 patent, col. 1, Ins. 31–34). This change in positioning of the base line removes the weight of the drilling fluid or hydrostatic pressure contained in a conventional riser from the formation. This objective is achieved by taking the fluid or mud returns at the mudline and pumping them to the surface rather than requiring the mud returns to be forced upward through the riser by the downward pressure of the mud column ('495 patent, col. 1, Ins. 35–40).

U.S. Pat. No. 4,836,289 proposes a method and apparatus for performing wire line operations in a well comprising a wire line lubricator assembly, which includes a centrally-bored tubular mandrel. A lower tubular extension is attached to the mandrel for extension into an annular blowout preventer. The annular blowout preventer is stated to remain open at all times during wire line operations, except for the testing of the lubricator assembly or upon encountering excessive well pressures. ('289 patent, col. 7, Ins. 53–62) The lower end of the lower tubular extension is provided with an enlarged centralizing portion, the external diameter of which is greater than the external diameter of the lower tubular extension, but less than the internal diameter of the bore of the bell nipple flange member. The wireline operation system of the '289 patent does not teach, suggest or provide any motivation for use a rotating control head, much less teach, suggest, or provide any motivation for sealing an annular blowout preventer with the lower tubular extension while drilling.

In cases where reasonable amounts of gas and small amounts of oil and water are produced while drilling underbalanced for a small portion of the well, it would be desirable to use conventional rig equipment, as shown in FIG. 1, in combination with a rotating control head, to control the pressure applied to the well while drilling. Therefore, a system and method for sealing either the riser or the sub-sea blowout preventer stack (BOPS) while drilling in deepwater that would allow a quick rig-up and release using conventional pressure containment equipment would be desirable. In particular, a system that provides sealing of the riser at any predetermined location, or, alternatively, is capable of sealing the BOPS while rotating the pipe, where the seal could be relatively quickly installed when required, and quickly removed when it is no longer required, would be desirable.

SUMMARY OF THE INVENTION

A system is disclosed for drilling in deepwater in the floor of an ocean using a rotatable pipe. The system uses an annular or ram blowout preventer to provide a seal, with or without a gas handler discharge outlet to convey pressurized mud returns from a riser to the rig while drilling. The blowout preventer is movable between a sealed position about an internal housing threadedly connected with a bearing assembly having a passage through which the rotatable pipe may extend to provide a barrier between two different fluid densities in the riser. The internal housing also includes a holding member or upset for blocking upward movement of the internal housing relative to the blowout preventer when the seal of the blowout preventer is in the sealed position. When the blowout preventer is in the sealed position about the internal housing and the pipe is rotated, the pressure of the fluid in the open borehole can be maintained at one density below the seal while another density fluid is maintained above the seal. When the blowout preventer seal is in the open position, the internal housing and the threadedly connected bearing assembly, can be removed relatively quickly from the riser.

Advantageously, a method for use of the system is also disclosed.

BRIEF DESCRIPTION OF THE DRAWINGS

A better understanding of the present invention can be obtained when the following detailed description of the preferred embodiment is considered in conjunction with the following drawings, in which:

FIG. 8 is an enlarged detail section view of the upset of the present invention;

FIG. 9 is section view taken along line 9—9 of FIG. 8; and

DETAILED DESCRIPTION OF THE INVENTION

Figure 2:
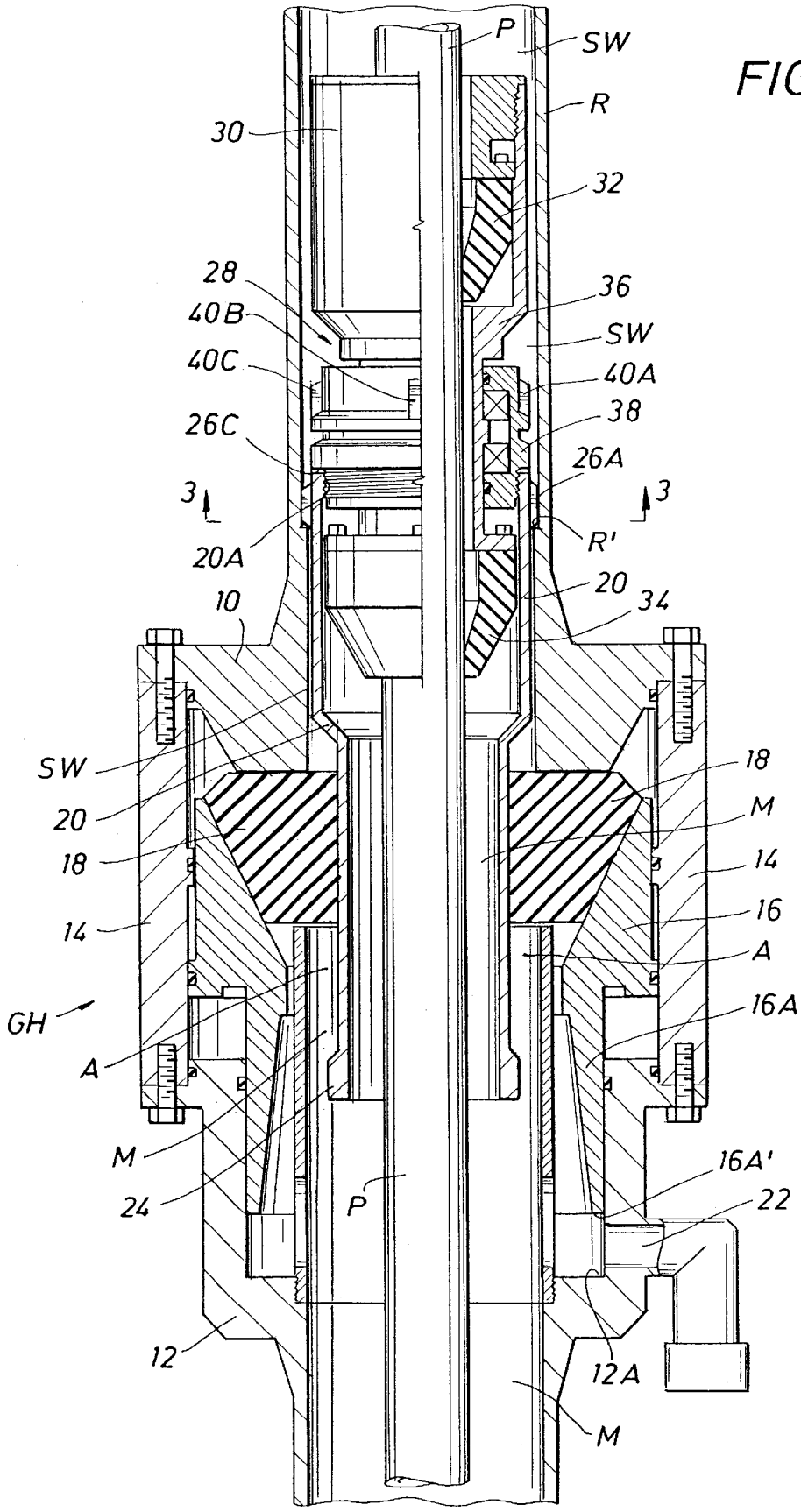
FIG. 2 is an elevational view of a blowout preventer in a sealed position to position an internal housing and bearing assembly of the present invention in the riser.
Figure 3:
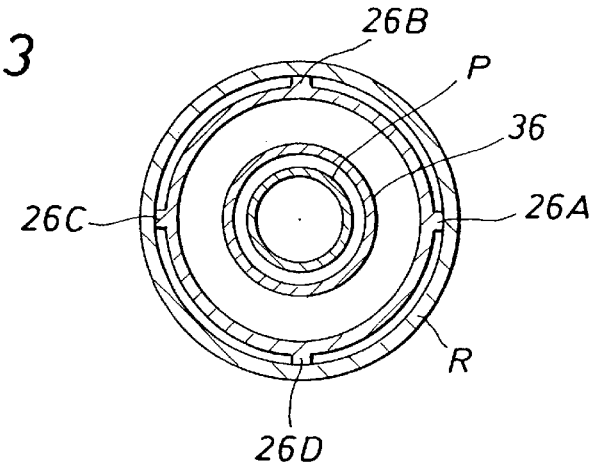
FIG. 3 is a section view taken along line 3—3 of FIG. 2.
Figure 5:
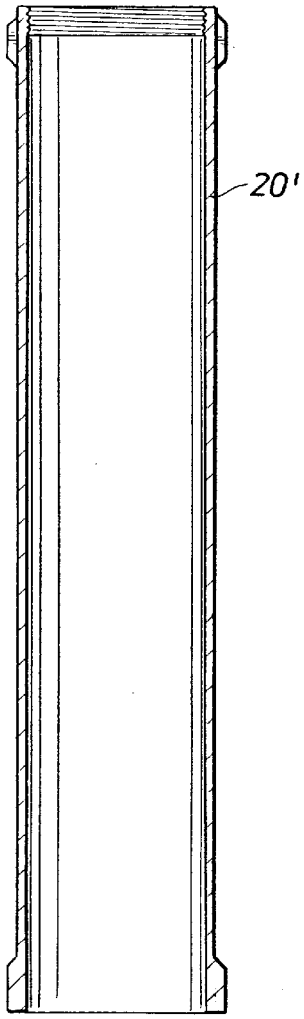
FIG. 5 is an elevational view of an alternative embodiment of the internal housing of the present invention.
Figure 6:
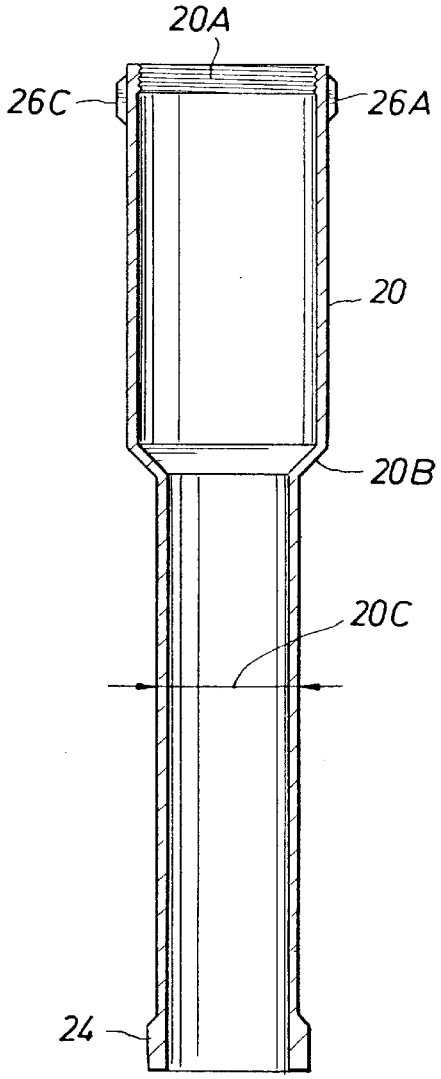
FIG. 6 is the preferred embodiment of the step down internal housing of the present invention.

FIGS. 2, 3 and 6 disclose preferred embodiments of the internal housing of the present invention, and FIG. 5 discloses an alternative embodiment of the internal housing of the present invention.

Turning to FIG. 2, the riser or upper tubular R is shown positioned above a gas handler annular blowout preventer, generally designated as GH. While a "HYDRIL" GH 21-2000 gas handler BOP or a "HYDRIL" GL series annular blowout handler could be used, ram type blowout preventers, such as Cameron U BOP, Cameron UII BOP or a Cameron T blowout preventer, available from Cooper Cameron Corporation of Houston, Tex., could be used. Cooper Cameron Corporation also provides a Cameron DL annular BOP. The gas handler annular blowout preventer GH includes an upper head 10 and a lower body 12 with an outer body or first housing 14 therebetween. A piston 16 having a lower wall 16A moves relative to the first housing 14 between a sealed position, as shown in FIG. 2, and an open position, where the piston moves downwardly until the end 16A' engages the shoulder 12A. In this open position, the annular packing unit or seal 18 is disengaged from the internal housing 20 of the present invention while the wall 16A blocks the gas handler discharge outlet 22. Preferably, the seal 18 has a height of 12 inches. While annular and ram type blowout preventers, with or without a gas handler discharge outlet, are disclosed, any seal to retractably seal about an internal housing to seal between a first housing and the internal housing is contemplated as covered by the present invention. The best type of retractable seal, with or without a gas handler outlet, will depend on the project and the equipment used in that project.

The internal housing 20 includes a continuous radially outwardly extending upset or holding member 24 proximate to one end of the internal housing 20, as will be discussed below in detail. When the seal 18 is in the open position, it also provides clearance with the holding member 24. As best shown in FIGS. 8 and 9, the upset 24 is preferably fluted with a plurality of bores, like bore 24A, to reduce hydraulic pistoning of the internal housing 20. The other end of the internal housing 20 preferably includes inwardly facing right-hand Acme threads 20A. As best shown in FIGS. 2 and 3, the internal housing includes four equidistantly spaced lugs 26A, 26B, 26C and 26D.

Figure 7:
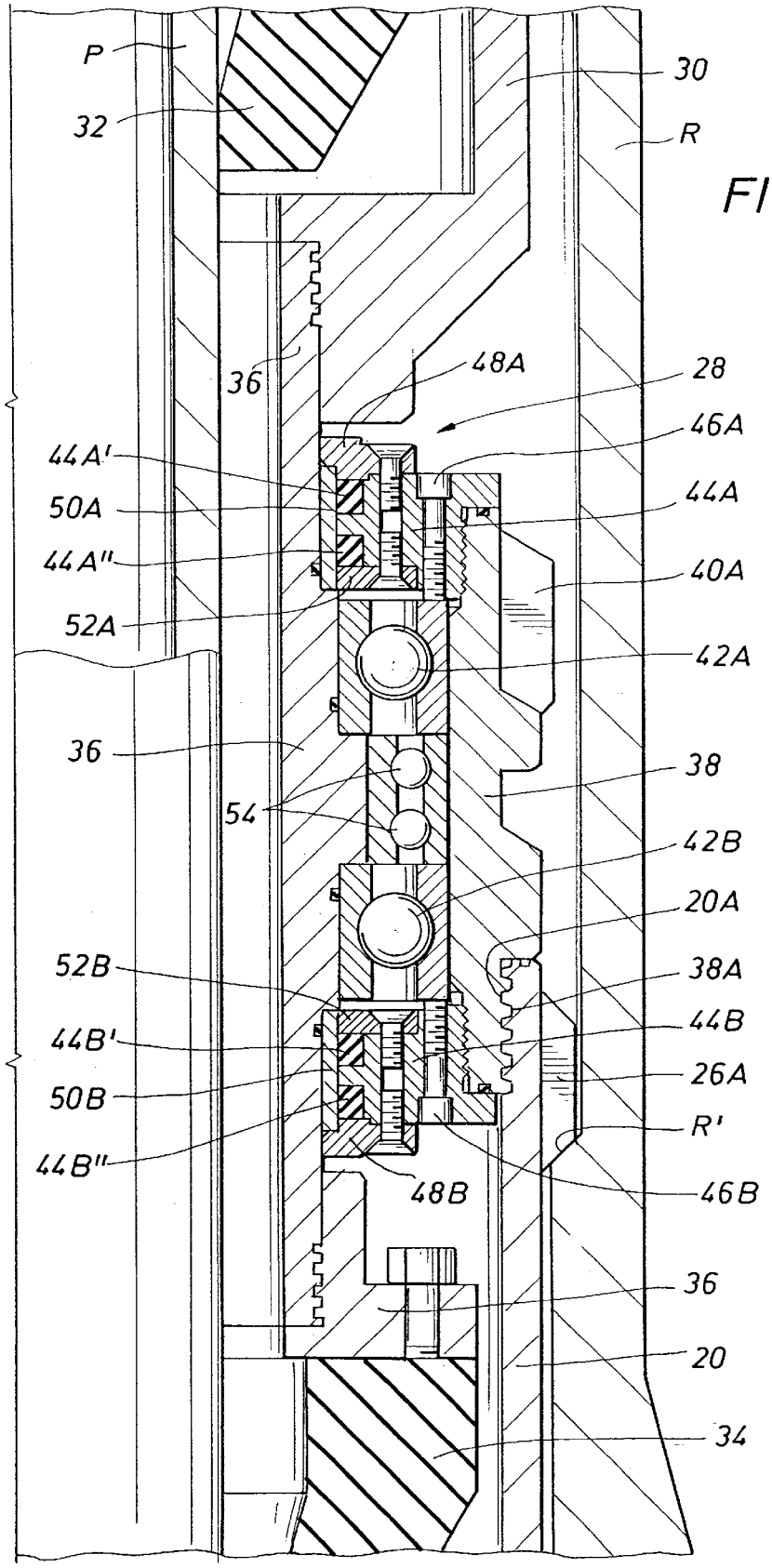
FIG. 7 is an enlarged section view of the bearing assembly of the present invention illustrating a typical lug on the outer member of the bearing assembly and a typical lug on the internal housing engaging a shoulder of the riser.

As best shown in FIGS. 2 and 7, the bearing assembly, generally designated 28, is similar to the Weatherford-Williams Model 7875 rotating control head, now available from Weatherford International, Inc. of Houston, Tex. Alternatively, Weatherford-Williams Models 7000, 7100, IP-1000, 7800, 8000/9000 and 9200 rotating control heads, now available from Weatherford International, Inc., could be used. Preferably, a rotating control head with two spaced-apart seals is used to provide redundant sealing. The major components of the bearing assembly 28 are described in U.S. Pat. No. 5,662,181, now owned by Weatherford U.S. Holdings, Inc. The '181 patent is incorporated herein by reference for all purposes. Generally, the bearing assembly 28 includes a top rubber pot 30 that is sized to receive a top stripper rubber or inner member seal 32. Preferably, a bottom stripper rubber or inner member seal 34 is connected with the top seal 32 by the inner member 36 of the bearing assembly 28. The outer member 38 of the bearing assembly 28 is rotatably connected with the inner member 26, as best shown in FIG. 7, as will be discussed below in detail.

Figure 10:
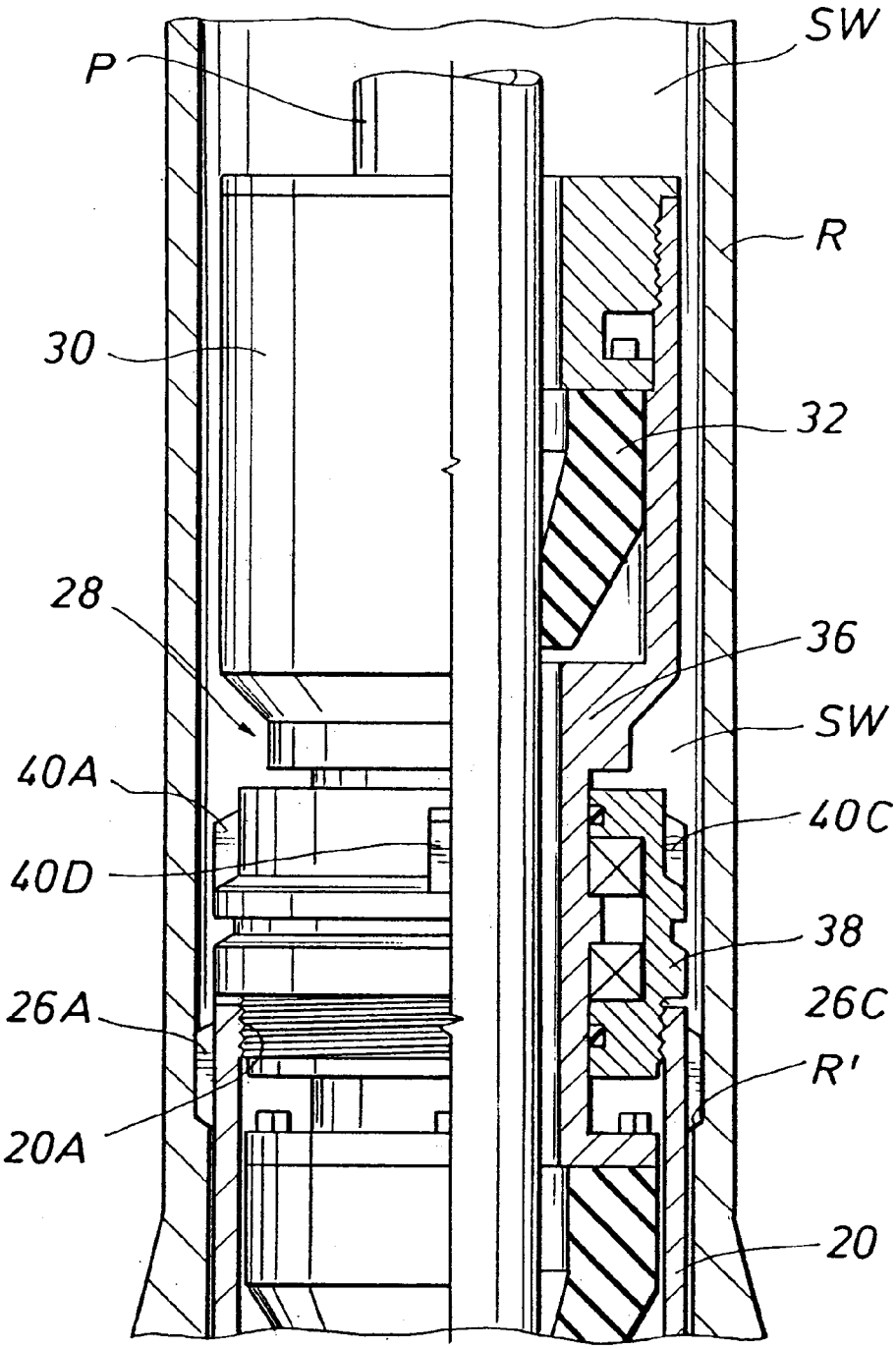
FIG. 10 is a reverse view of a portion of FIG. 2.

The outer member 38 includes four equidistantly spaced lugs. A typical lug 40A is shown in FIGS. 2, 7, and 10, and lug 40C is shown in FIGS. 2 and 10. Lug 40B is shown in FIG. 2. Lug 40D is shown in FIG. 10. As best shown in FIG. 7, the outer member 38 also includes outwardly-facing right-hand Acme threads 38A corresponding to the inwardly-facing right-hand Acme threads 20A of the internal housing 20 to provide a threaded connection between the bearing assembly 28 and the internal housing 20.

Three purposes are served by the two sets of lugs 40A, 40B, 40C and 40D on the bearing assembly 28 and 26A, 26B, 26C and 26D on the internal housing 20. First, both sets of lugs serve as guide/wear shoes when lowering and retrieving the threadedly connected bearing assembly 28 and internal housing 20, both sets of lugs also serve as a tool backup for screwing the bearing assembly 28 and housing 20 on and off, lastly, as best shown in FIGS. 2 and 7, the lugs 26A, 26B, 26C and 26D on the internal housing 20 engage a shoulder R' on the upper tubular or riser R to block further downward movement of the internal housing 20, and, therefore, the bearing assembly 28, through the bore of the blowout preventer GH. The Model 7875 bearing assembly 28 preferably has a 8¾" internal diameter bore and will accept tool joints of up to 8½" to 8⅝", and has an outer diameter of 17" to mitigate pistoning problems in a 19½" internal diameter marine riser R. The internal diameter below the shoulder R' is preferably 18¾". The outer diameter of lugs 40A, 40B, 40C and 40D and lugs 26A, 26B, 26C and 26D are preferably sized at 19" to facilitate their function as guide/wear shoes when lowering and retrieving the bearing assembly 28 and the internal housing 20 in a 19½" internal diameter marine riser R.

Returning again to FIGS. 2 and 7, first, a rotatable pipe P can be received through the bearing assembly 28 so that both inner member seals 32 and 34 sealably engage the bearing assembly 28 with the rotatable pipe P. Secondly, the annulus A between the first housing 14 and the riser R and the internal housing 20 is sealed using seal 18 of the annular blowout preventer GH. These above two sealings provide a desired barrier or seal in the riser R both when the pipe P is at rest or while rotating. In particular, as shown in FIG. 2, seawater or a fluid of one density SW could be maintained above the seal 18 in the riser R, and mud M, pressurized or not, could be maintained below the seal 18.

Turning now to FIG. 5, a cylindrical internal housing 20' could be used instead of the preferred step-down internal housing 20 having a step down 20B to reduced diameter 20C of 14", as best shown in FIGS. 2 and 6. Both of these internal housings 20 and 20' could be at different lengths and sizes to accommodate different blowout preventers selected or available for use. Preferably, the blowout preventer GH, as shown in FIG. 2, could be positioned in a predetermined elevation between the wellhead W and the rig floor F. In particular, it is contemplated that an optimized elevation of the blowout preventer could be calculated, so that the separation of the mud M, pressurized or not, from seawater or gas-cut mud SW would provide a desired initial hydrostatic pressure in the open borehole, such as the borehole B, shown in FIG. 4. This initial pressure could then be adjusted by pressurizing or gas-cutting the mud M.

Figure 4:
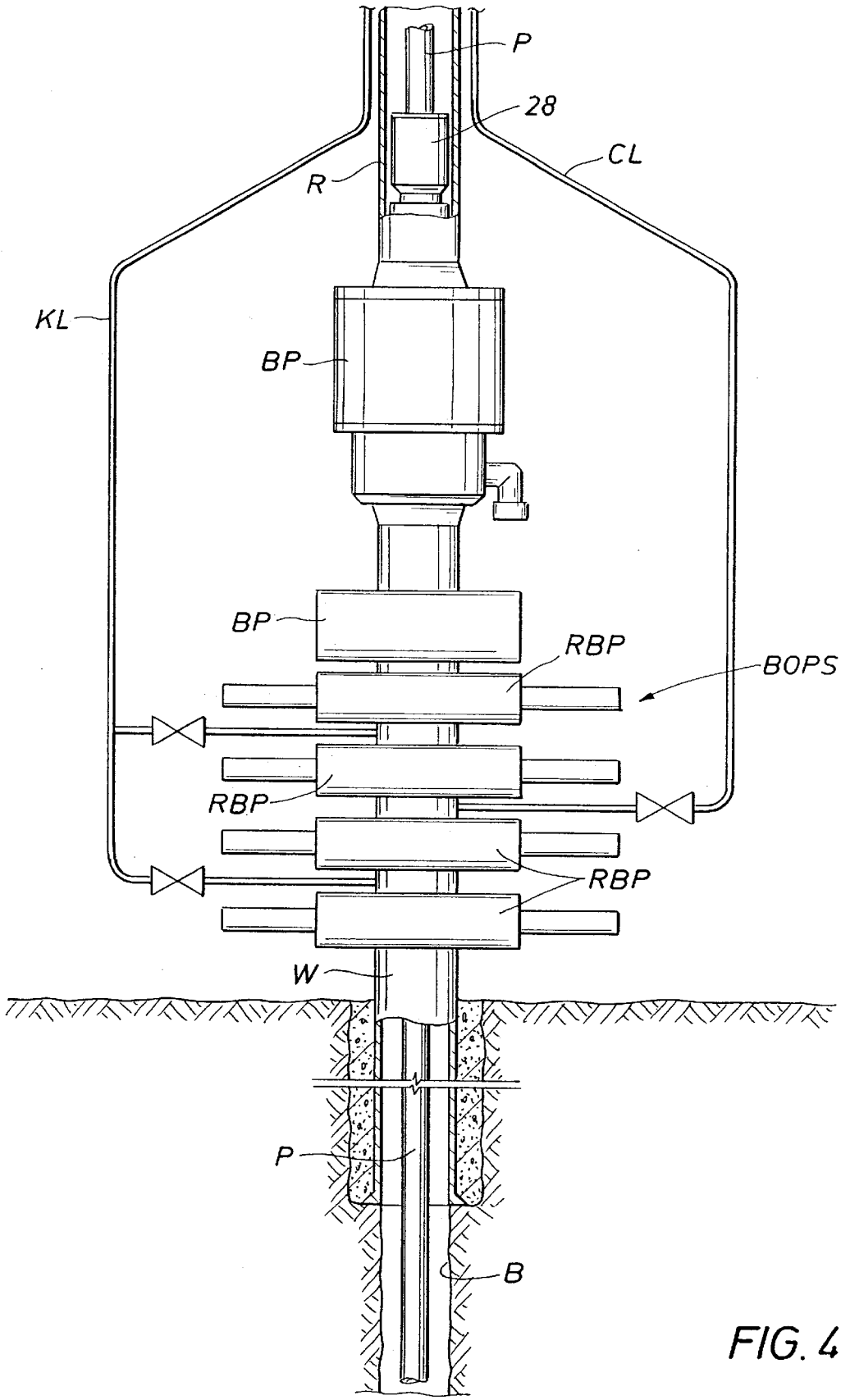
FIG. 4 is an enlarged elevational view of a blowout preventer stack positioned above a wellhead, similar to the lower portion of FIG. 1, but with the internal housing and bearing assembly of the present invention positioned in a blowout preventer communicating with the top of the blowout preventer stack and a rotatable pipe extending through the bearing assembly and internal housing of the present invention and into an open borehole.

Turning now to FIG. 4, the blowout preventer stack, generally designated BOPS, is in fluid communication with the choke line CL and the kill line KL connected between the desired ram blowout preventers RBP in the blowout preventer stack BOPS, as is known by those skilled in the art. In the embodiment shown in FIG. 4, two annular blowout preventers BP are positioned above the blowout preventer stack BOPS between a lower tubular or wellhead W and the upper tubular or riser R. Similar to the embodiment shown in FIG. 2, the threadedly connected internal housing 20 and bearing assembly 28 are positioned inside the riser R by moving the annular seal 18 of the top annular blowout preventer BP to the sealed position. As shown in FIG. 4, the annular blowout preventer BP does not include a gas handler discharge outlet 22, as shown in FIG. 2. While an annular blowout preventer with a gas handler outlet could be used, fluids could be communicated without an outlet below the seal 18, to adjust the fluid pressure in the borehole B, by using either the choke line CL and/or the kill line KL.

Turning now to FIG. 7, a detail view of the seals and bearings for the Model 7875 Weatherford-Williams rotating control head, now sold by Weatherford International, Inc., of Houston, Tex., is shown. The inner member or barrel 36 is rotatably connected to the outer member or barrel 38 and preferably includes 9000 series tapered radial bearings 42A and 42B positioned between a top packing box 44A and a bottom packing box 44B. Bearing load screws, similar to screws 46A and 46B, are used to fasten the top plate 48A and bottom plate 48B, respectively, to the outer barrel 38. Top packing box 44A includes packing seals 44A' and 44A" and bottom packing box 44B includes packing seals 44B' and 44B" positioned adjacent respective wear sleeves 50A and 50B. A top retainer plate 52A and a bottom retainer plate 52B are provided between the respective bearing 42A and 42B and packing box 44A and 44B. Also, two thrust bearings 54 are provided between the radial bearings 42A and 42B.

USE AND OPERATION

As can now be seen, the internal housing 20 and bearing assembly 28 of the present invention provide a barrier in a first housing 14 while drilling that allows a quick rig up and release using a conventional upper tubular or riser R and blowout preventer. In particular, the barrier can be provided in the riser R while rotating pipe P, where the barrier can relatively quickly be installed or tripped relative to the riser R, so that the riser could be used with underbalanced drilling, a dual density system or any other drilling technique that requires pressure containment.

In particular, the threadedly assembled internal housing 20 and the bearing assembly 28 could be run down the riser R on a standard drill collar or stabilizer (not shown) until the lugs 26A, 26B, 26C and 26D of the assembled internal housing 20 and bearing assembly 28 are blocked from further movement upon engagement with the shoulder R' of riser R. The fixed preferably radially continuous upset or holding member 24 at the lower end of the internal housing 20 would be sized relative to the blowout preventer so that the upset 24 is positioned below the seal 18 of the blowout preventer. The annular or ram type blowout preventer, with or without a gas handler discharge outlet 22, would then be moved to the sealed position around the internal housing 20 so that a seal is provided in the annulus A between the internal housing 20 and the first housing 14 or riser R. As discussed above, in the sealed position the gas handler discharge outlet 22 would then be opened so that mud M below the seal 18 can be controlled while drilling with the rotatable pipe P sealed by the preferred internal seals 32 and 34 of the bearing assembly 28. As also discussed above, if a blowout preventer without a gas handler discharge outlet 22 were used, the choke line CL, kill line KL or both could be used to communicate fluid, with the desired pressure and density, below the seal 18 of the blowout preventer to control the mud pressure while drilling.

Because the present invention does not require any significant riser or blowout preventer modifications, normal rig operations would not have to be significantly interrupted to use the present invention. During normal drilling and tripping operations, the assembled internal housing 20 and bearing assembly 28 could remain installed and would only have to be pulled when large diameter drill string components were tripped in and out of the riser R. During short periods when the present invention had to be removed, for example, when picking up drill collars or a bit, the blowout preventer stack BOPS could be closed as a precaution with the diverter D and the gas handler blowout preventer GH as further backup in the event that gas entered the riser R.

Figure 1:
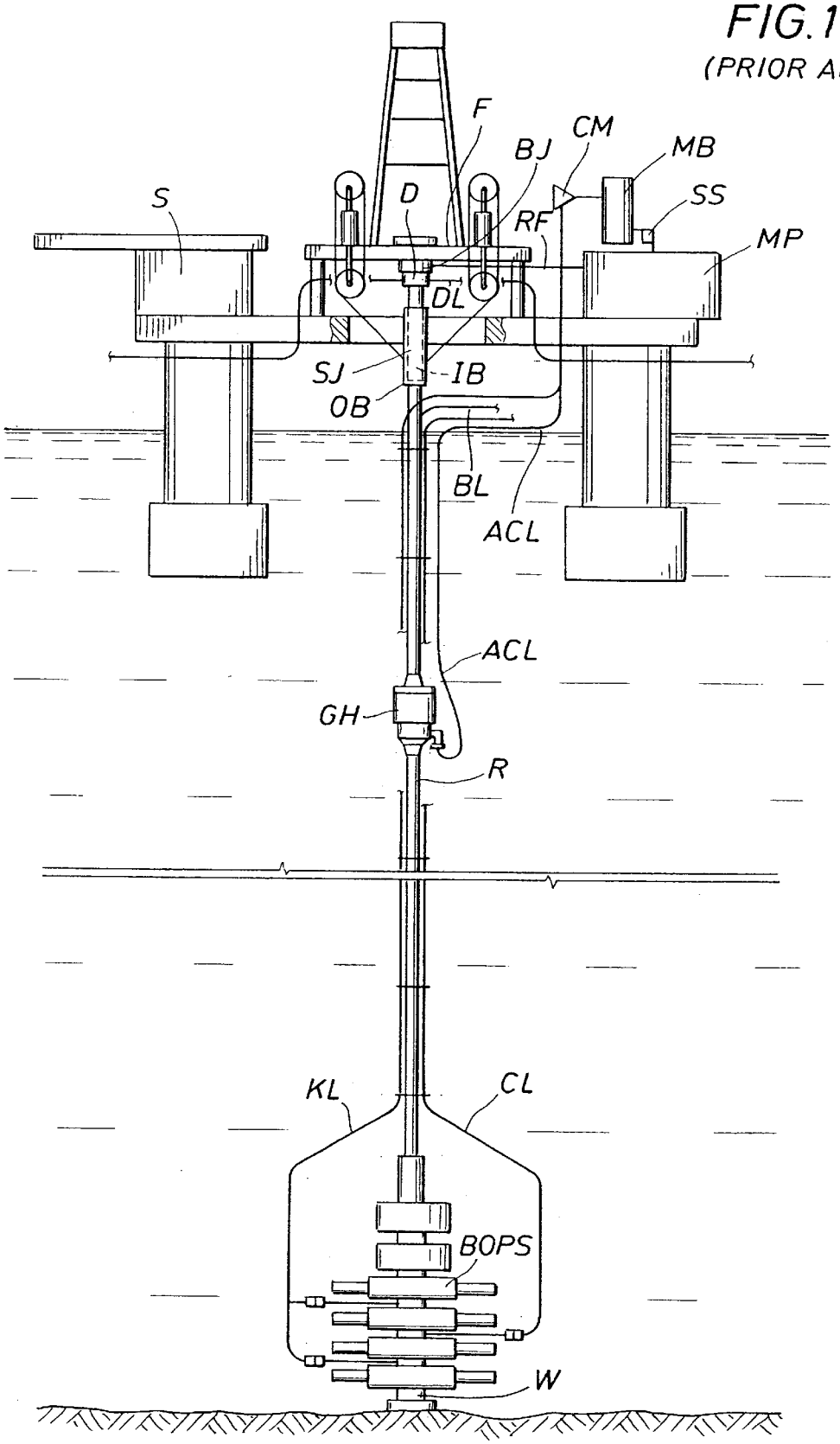
FIG. 1 (PRIOR ART)
FIG. 1 is an elevational view of a prior art floating rig mud return system, shown in broken view, with the lower portion illustrating the conventional subsea blowout preventer stack attached to a wellhead and the upper portion illustrating the conventional floating rig, where a riser having a conventional blowout preventer connected to the floating rig.

As best shown in FIGS. 1, 2 and 4, if the gas handler discharge outlet 22 were connected to the rig S choke manifold CM, the mud returns could be routed through the existing rig choke manifold CM and gas handling system. The existing choke manifold CM or an auxiliary choke manifold (not shown) could be used to throttle mud returns and maintain the desired pressure in the riser below the seal 18 and, therefore, the borehole B.

As can now also be seen, the present invention along with a blowout preventer could be used to prevent a riser from venting mud or gas onto the rig floor F of the rig S. Therefore, the present invention, properly configured, provides a riser gas control function similar to a diverter D or gas handler blowout preventer GH, as shown in FIG. 1, with the added advantage that the system could be activated and in use at all times—even while drilling.

Because of the deeper depths now being drilled offshore, some even in ultradeepwater, tremendous volumes of gas are required to reduce the density of a heavy mud column in a large diameter marine riser R. Instead of injecting gas into the riser R, as described in the Background of the Invention, a blowout preventer can be positioned in a predetermined location in the riser to provide the desired initial column of mud, pressurized or not, for the open borehole B since the present invention now provides a barrier between the one fluid, such as seawater, above the seal 18 of the blowout preventer, and mud M, below the seal 18. Instead of injecting gas into the riser above the seal 18, gas is injected below the seal 18 via either the choke line CL or the kill line KL, so less gas is required to lower the density of the mud column in the other remaining line, used as a mud return line.

The foregoing disclosure and description of the invention are illustrative and explanatory thereof, and various changes in the details of the illustrated apparatus and construction and method of operation may be made without departing from the spirit of the invention.

What is claimed is:

1. A system adapted for forming a borehole using a rotatable pipe and a fluid, the system comprising:

an upper tubular disposed above the borehole;

a bearing assembly having an inner member and an outer member and being positioned within said upper tubular, said inner member rotatable relative to said outer member and having a passage through which the rotatable pipe may extend;

a bearing assembly seal to sealably engage the rotatable pipe with said bearing assembly; and a holding member for positioning said bearing assembly within said upper tubular.

2. The system of claim 1, further comprising:

a first housing disposed between said borehole and said upper tubular, and a first housing seal disposed with said first housing.

3. The system of claim 2, wherein said first housing seal includes an annular seal having a first opening and a second opening.

4. The system of claim 2, further comprising:

a stack positioned from an ocean floor, wherein said first housing is positioned above and in fluid communication with said stack.

5. The system of claim 2, wherein said first housing seal is movable between a sealed position and an open position.

6. The system of claim 2, wherein said first housing is sealed with said bearing assembly by said first housing seal to allow the rotatable pipe to rotate.

7. The system of claim 2, further comprising:

an internal housing, wherein said bearing assembly is removably positioned with said internal housing.

8. The system of claim 7, wherein said holding member extends from said internal housing.

9. The system of claim 8, wherein said first housing seal is movable between a sealed position and an open position, whereby said first housing is sealed between said holding member and said bearing assembly when said first housing seal is in the sealed position .

10. The system of claim 8, whereby said first housing seal and said holding member block movement of said internal housing.

11. A system adapted for forming a borehole having a borehole fluid pressure, the system using a rotatable pipe and a fluid having a pressure, the system comprising:

a first housing disposed above said borehole;

an upper tubular disposed above said first housing;

a bearing assembly having an inner member and an outer member and being removably positioned with said upper tubular, said inner member rotatable relative to said outer member and having a passage through which the rotatable pipe may extend;

a bearing assembly seal to sealably engage the rotatable pipe;

a holding member for removably positioning said bearing assembly with said first housing; and a first housing seal disposed in said first housing, said bearing assembly sealed with said first housing by said first housing seal, whereby the pressure of the fluid can be increased for controlling the borehole fluid pressure.

12. The system of claim 11, wherein said first housing is an annular blowout preventer housing.

13. The system of claim 11, further comprising:

an internal housing, wherein said bearing assembly is removably positioned with said internal housing.

14. The system of claim 13, wherein said holding member has a shoulder extending from said bearing assembly.

15. The system of claim 13, wherein said internal housing is removably positioned with said first housing.

16. The system of claim 15, wherein said first housing seal is movable between a sealed position and an open position, whereby said first housing is sealed with said internal housing by said first housing seal when said first housing seal is in the sealed position, and whereby said internal housing is removable from said first housing when said first housing seal is in the open position.

17. A system adapted for forming a borehole in a floor of an ocean, the borehole having a borehole fluid pressure, the system using a fluid having a pressure, the system comprising:

a lower tubular adapted to be fixed relative to the floor of the ocean;

a first housing disposed above said lower tubular;

an upper tubular disposed above said first housing;

a bearing assembly having an inner member and an outer member and being removably positioned with said upper tubular, said inner member rotatable relative to said outer member and having a passage;

a bearing assembly seal disposed with said inner member;

an internal housing having a holding member, said internal housing receiving said bearing assembly, said holding member extending from said internal housing and into said first housing; and a first housing seal disposed in said first housing, said first housing seal movable between a sealed position and an open position, whereby said internal housing seals with said first housing seal when said first housing seal is in the sealed position, whereby the pressure of the fluid can be increased for controlling the borehole fluid pressure.

18. A method for increasing the pressure of a fluid in a borehole while sealing a rotatable pipe, comprising the steps of:

positioning an upper tubular above the borehole;

holding a bearing assembly within said upper tubular;

limiting the positioning of said bearing assembly within said upper tubular;

sealing said bearing assembly with the rotatable pipe; and sealing said upper tubular with said bearing assembly to control the pressure of the fluid in the borehole, wherein said bearing assembly has an inner member and an outer member, wherein said inner member is rotatable relative to said outer member, and wherein said inner member has a passage through which the rotatable pipe may extend.

19. The method of claim 18, further comprising the step of:

rotating the rotatable pipe while increasing the pressure of the fluid in the borehole.

20. The method of claim 18, further comprising the step of:

sealing said bearing assembly with an internal housing sized to be received within said upper tubular.

21. The method of claim 20, further comprising the steps of:

positioning a first housing between said upper tubular and the borehole, and sealing said first housing with said internal housing to seal said upper tubular with said bearing assembly.

22. The method of claim 21, further comprising the step of:

moving a first housing seal from an open position to a sealed position for sealing said first housing with said internal housing.

23. A rotating control head system, comprising:

an outer member, removably positionable within an upper tubular;

an inner member, disposed within said outer member, said inner member having a passage running therethrough, said inner member adapted to receive and sealingly engage a rotatable pipe;

a plurality of bearings disposed between said outer member and said inner member, to rotate said inner member relative to said outer member when the inner member is sealingly engaged with said rotatable pipe;

a first housing, connectable to said upper tubular and disposed above said borehole, said outer member removably extending into said first housing, said first housing having a seal for sealing with said outer member; and a holding member for limiting positioning of said outer member within said first housing.

24. The rotating control head system of claim 23, wherein said seal moves between an open position and a closed position, said outer member sealed within said first housing by said seal when said seal is in said closed position, and said seal allowing positioning of said outer member within said first housing when said seal is in said open position, and wherein said holding member limits upwards movement of said outer member within said seal when said seal is in said closed position.

25. The rotating control head system of claim 24.

wherein said upper tubular contains an upper fluid having an upper fluid pressure, wherein said borehole contains a lower fluid having a lower fluid pressure, and wherein when said seal is in said closed position, said upper fluid pressure can differ from said lower fluid pressure.

26. The rotating control head system of claim 23, said holding member comprising:

a plurality of bores to reduce hydraulic pistoning of said outer member within said upper tubular when moving said outer member within said upper tubular.

27. The rotating control head system of claim 23, said holding member comprising:

a continuous radially outwardly extending upset.

28. The rotating control head system of claim 23, said upper tubular comprising:

a landing shoulder;

said outer member further comprising:

an upper limit means for limiting downward movement of said outer member within said upper tubular.

29. The rotating control head system of claim 28, said upper limit means comprising:

a plurality of lugs connected to said outer member at a predetermined upper limit position, said plurality of lugs engaging said landing shoulder.

30. A method of dual-density drilling a borehole, comprising the steps of:

positioning a first housing above the borehole;

positioning an upper tubular with said first housing;

moving a rotating control head through said upper tubular to said first housing;

extending a rotatable pipe through said rotating control head and into the borehole;

limiting the positioning of the rotating control head within the upper tubular;

sealing said rotating control head with said first housing;

sealing an inner member of said rotating control head to said rotatable pipe, said inner member rotating with said rotatable pipe relative to said outer member, providing a lower fluid within the borehole, said lower fluid having a first fluid pressure;

providing an upper fluid within said upper tubular, said upper fluid having second fluid pressure, said second fluid pressure different from said first fluid pressure.

31. The method of claim 30, further comprising the step of:

limiting upper movement of said rotating control head when said rotating control head is sealed with said first housing.

32. The method of claim 30, the step of sealing the rotating control head comprising the step of:

closing an annular seal disposed within said first housing, said annular seal engaging said outer member.

33. The method of claim 30, wherein the borehole is in an ocean floor.

34. The method of claims 30, further comprising:

drilling the borehole while said inner member is sealed to said rotatable pipe and said first housing is sealed to said outer member.

35. A system adapted for forming a borehole using a rotatable pipe and a fluid, the system comprising:

a first housing having a bore running therethrough;

a bearing assembly disposed in said bore, said bearing assembly comprising an inner member and an outer member for rotatably supporting said inner member, said inner member being adapted to slidingly receive and sealingly engage the rotatable pipe, wherein rotation of the rotatable pipe rotates said inner member within said bore;

a holding member for positioning said bearing assembly within said first housing; and a seal disposed in an annular cavity in said first housing, said seal having an elastomeric element for sealingly engaging said bearing assembly to said first housing.

36. An internal riser rotating control head, comprising:

a housing having a bore running therethrough;

a bearing assembly disposed in said bore, said bearing assembly comprising an inner member and an outer member for rotatably supporting said inner member, said inner member being adapted to slidingly receive and sealingly engage the rotatable pipe, wherein rotation of the rotatable pipe rotates said inner member within said bore, the inner member having thereon a pair of sealing elements;

a holding member for positioning said bearing assembly within said first housing; and a seal disposed in said housing for securing said bearing assembly to said housing.

* * * * *